US006076915A

United States Patent [19]

Gast et al.

[11] Patent Number: 6,076,915

[45] Date of Patent: Jun. 20, 2000

[54] INKJET PRINTHEAD CALIBRATION

[75] Inventors: Paul David Gast, Camas; Mark S Hickman, Vancouver, both of Wash.; David H. Donovan, Barcelona, Spain; Xavier Gros, Barcelona, Spain; Antoni Gil Miquel, Barcelona, Spain

[73] Assignee: Hewlett-Packard Company, Palo Alto, Calif.

[21] Appl. No.: 09/128,455

[22] Filed: Aug. 3, 1998

[51] Int. Cl.[7] ..... B41J 29/393

[52] U.S. Cl. ..... 347/19; 358/406; 358/504

[58] Field of Search ..... 347/18, 43, 37; 358/504, 506

[56] References Cited

U.S. PATENT DOCUMENTS

| | | | |
|---|---|---|---|
| 4,675,696 | 6/1987 | Suzuki | 346/46 |
| 4,922,268 | 5/1990 | Osborne | 347/19 |
| 4,922,270 | 5/1990 | Cobbs et al. | 347/19 |
| 5,036,340 | 7/1991 | Osborne | 347/19 |
| 5,109,239 | 4/1992 | Cobbs et al. | 347/19 |
| 5,289,208 | 2/1994 | Haselby | 347/19 |
| 5,297,017 | 3/1994 | Haselby et al. | 347/19 |
| 5,313,287 | 5/1994 | Barton | 358/458 |
| 5,397,192 | 3/1995 | Khormaee | 400/708 |
| 5,404,020 | 4/1995 | Cobbs | 250/548 |
| 5,448,269 | 9/1995 | Beauchamp et al. | 347/19 |
| 5,451,990 | 9/1995 | Sorenson et al. | 347/37 |
| 5,530,460 | 6/1996 | Wehl | 347/19 |
| 5,534,895 | 7/1996 | Lindenfelser et al. | 347/19 |
| 5,600,350 | 2/1997 | Cobbs et al. | 347/19 |

FOREIGN PATENT DOCUMENTS

| | | | |
|---|---|---|---|
| 589718 | 3/1990 | European Pat. Off. . | |
| 540244 | 5/1993 | European Pat. Off. . | |
| 622238 | 11/1994 | European Pat. Off. . | |
| 667241 | 8/1995 | European Pat. Off. . | |
| 671275 | 9/1995 | European Pat. Off. . | |
| 4015799 | 11/1991 | Germany . | |
| 63-153151 | 6/1988 | Japan | 347/19 |
| 2311601 | 10/1997 | United Kingdom . | |

OTHER PUBLICATIONS

European Search Report dated Dec. 13, 1999 for related European patent application EP99306098.7–2304, filed Aug. 3, 1998.

*Primary Examiner*—John Barlow
*Assistant Examiner*—Craig A. Hallacher

[57] ABSTRACT

In various methods, image registration variations among test patterns are used to calibrate misalignment among one or more printheads, paper advance distance, different portions of an inkjet printhead, or bidirectional printhead alignment. A set of test patterns are printed. Each pattern includes a reference portion and a varying portion. The varying portion is changed from pattern to pattern in a manner for testing a parameter being calibrated. An optical sensor scans each test pattern. The parameter setting for the lest pattern having the highest reflectance (i.e., most blank space) is selected as the calibrated parameter value.

23 Claims, 7 Drawing Sheets

FIG. 5
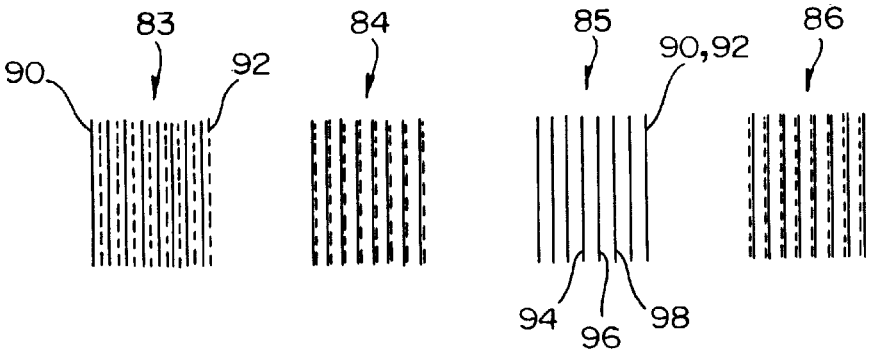
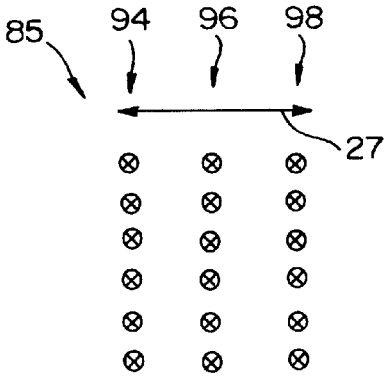
FIG. 6
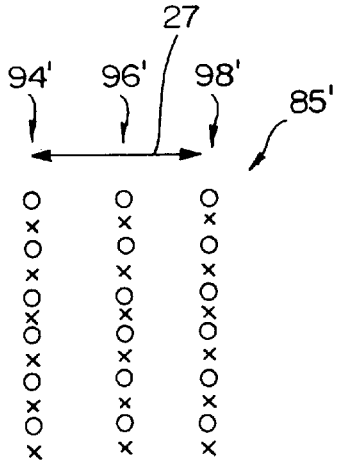
FIG. 7
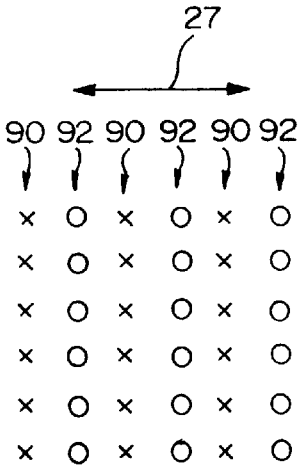
FIG. 8

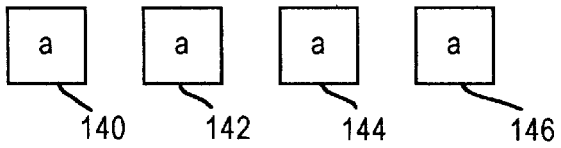
FIG.14A
FIG.14B
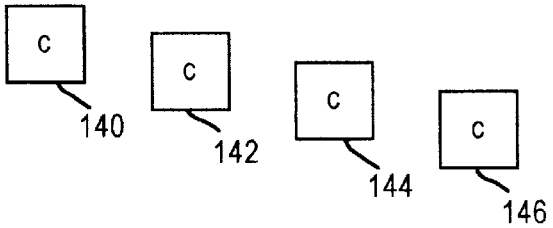
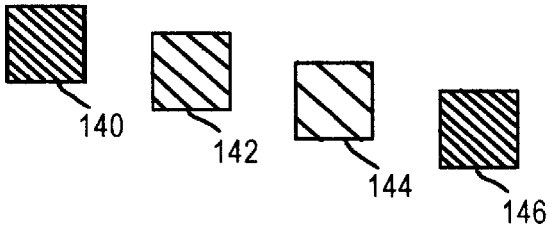
FIG.14C
FIG.15A
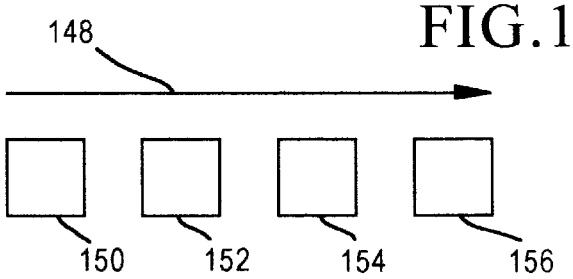
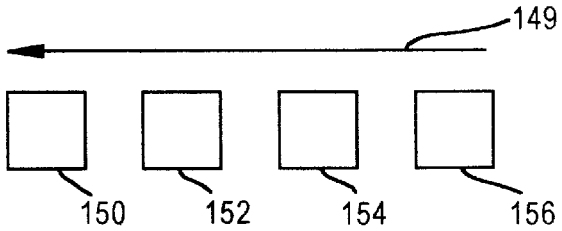
FIG.15B

INKJET PRINTHEAD CALIBRATION

BACKGROUND OF THE INVENTION

This invention relates generally to printers, plotters, and marking devices, and more particularly, to inkjet printers, plotters and marking devices having multiple printheads for multi-color printing.

Inkjet marking devices typically include one or more inkjet pens mounted on a carriage. Each pen includes a printhead having a plurality of inkjet nozzles. During printing, the carriage moves across a media sheet while the nozzles discharge ink drops. The timing of the ink drop ejection is controlled to precisely place the drops at desired locations.

A typical multi-color inkjet marking device includes two or more inkjet pens with respective printheads. One pen stores black ink, while the others store ink of one or more colors, (e.g., cyan, magenta or yellow). The four inks represent four base colors which are applied to a media sheet to derive any of multiple colors.

The pens typically are mounted in stalls within the carriage. To achieve desired print quality the ink colors need to be precisely placed at desired locations on the media sheet. To do so the pen printheads are to be maintained in precise alignment. The pens typically are loaded and replaced periodically by the end user. As a result, mechanical misalignment is likely to occur. Mechanical misalignment results in offsets of one or more pens' nozzles relative to the other pens' nozzles. This misalignment manifests as a misregistration of the dots forming a print symbol, image, or graphic representation. Other sources of misalignment also may occur due to the speed of motion of the carriage, the curvature of the platen and the spray of the nozzles.

One conventional approach for aligning the pens is to use an optical drop detector. This technique is described in U.S. Pat. No. 4,922,270, issued May 1, 1990 to Cobbs et al., entitled "Inter Pen Offset Determination and Compensation in Multi-Pen Thermal Ink Jet Printing Systems." The optical drop detectors detect the position of each ink drop as it leaves the pen. The system then calculates the point of impact of the drop on the print media. Unfortunately the actual impact point often differs substantially from the calculated impact point due to angularity and mechanical tolerances in the system. Angularity results from the movement of the pen in the scan axis as ink is being ejected. There is a delay between the time that the drop of ink is ejected and the time that the drop impacts the media. This flight time delay causes the drop to traverse an angular path toward the media. Inaccurate correction for this delay distorts the image.

U.S. Pat. No. 5,289,208 issued Feb. 22, 1994 of Robert D. Haselby entitled "Automatic Print Cartridge Alignment Sensor System" discloses a technique in which an optical sensor detects the position of test line segments. Vertical alignment is achieved by printing a plurality of non-overlapping horizontal test line segments. A quad photodiode detector detects the vertical positions of the horizontal test line segments relative to a fixed reference. Horizontal alignment is achieved by printing a plurality of non-overlapping vertical test line segments in a vertical direction. If properly aligned the line segments connect to form a straight line (e.g., for printing 2 line segments the line is 2 line segments long). If misaligned, the line segments form an angled line (e.g., for printing 2 line segments the line is 2 line segments long). A quad photodiode detector detects the horizontal positions of the vertical test line segments to determine if the segments are aligned.

U.S. Pat. No. 5,451,990 discloses a reference pattern for use in performing image registration for multiple inkjet cartridges. The reference pattern includes four test patterns. One test pattern is generated along the scan axis to exercise the pens. It includes an individual section for each color. A second test pattern is used to test for pen offset due to speed and curvature. The second pattern is a bidirectional test pattern in which the cartridge is moved at differing speeds in each direction. A pattern is generated for each color. A third pattern is generated by causing each pen to print a plurality of horizontally spaced vertical bars. The fourth pattern includes five columns of vertically spaced horizontal bars. Each column has three sections. The first section in each column is generated using one color (e.g., cyan). In the second section the same color (cyan) is used in columns one and five. The other colors are used respectively in columns 2–4 (e.g., magenta in column 2; yellow in column 3; black in column 4). In the third section of each column, the first color (cyan) is used. Note that the colors do not overlap in any of the patterns.

SUMMARY OF THE INVENTION

According to the invention, an inkjet printhead is calibrated to achieve precise dot alignment. In one method image registration is calibrated for each of multiple printheads to account for printhead misalignment. In another method a paper advance distance is calibrated. In yet another method different portions of an inkjet printhead are calibrated. In still another method print alignment for bidirectional printing is calibrated.

For the image registration method, alignment of a given printhead is calibrated for one or more axes (e.g., scanning axis and/or media axis) using a set of test patterns. Each test pattern includes ink from at least two printheads of differing colored ink. The same inks are used in each test pattern. The test pattern may include a plurality of lines, circles, diamonds or other shapes. Preferably, each of the printheads prints multiple bars spaced along a given axis being calibrated. Each bar is one or more dots wide. For precise alignment the bars overlay each other, so that the space between the bars of a given printhead is blank. The image registration of the printhead under test is varied from one test pattern to the next in the set of test patterns. Thus, in some of the test patterns, the space between patterns of a given printhead may include ink from another printhead. An optical sensor measures the reflectance of each test pattern in the set of test patterns. The test pattern exhibiting the highest reflectance (i.e., the most blank media sheet background) is selected. The registration used for the selected test pattern is chosen to be the desired registration along the given axis for the printhead being calibrated. The process is repeated using bars spaced along another axis to calibrate the printhead alignment for such other axis. In some embodiments the registration of more than one printhead is varied for each test pattern in a set of test patterns.

According to one aspect of the invention, one printhead is selected as a reference printhead. The registration of the other printheads are adjusted relative to the position of the reference printhead. Horizontal registration of one printhead relative to the reference printhead is achieved by printing a row of test patterns including ink from the printhead being calibrated and the reference printhead. Thus, for a four printhead system there are three rows of test patterns used to determine horizontal registration. Each test pattern in the row includes a plurality of horizontally spaced vertical bars. The vertical bars are of the reference ink and the ink from the printhead under test. For ideal image registration the space between the vertical bars is blank. For misalignment some of the media sheet area is the reference printhead's ink color, some is the printhead under test's ink color, and some is blank. As the registration changes from test pattern to test pattern in a given row, the amount of blank space varies for each test pattern. The more blank space appearing for a white media sheet, the higher the reflectance detected by an optical sensor. The registration having the highest reflectance is chosen for each printhead under test to perform horizontal registration.

According to another aspect of the invention, vertical registration is determined by printing a row of test patterns including ink from the printhead being calibrated and ink from the reference printhead. Each test pattern, however, includes a plurality of vertically spaced horizontal bars. The vertical registration of the printhead under test is varied for each test pattern in the row. The horizontal bars are of the reference ink and the ink from the printhead under test. For ideal registration the space between the horizontal bars is blank. For misalignment some of the media sheet area is the reference printhead's ink color, some is the printhead under test's ink color, and some is blank. As the registration changes from test pattern to test pattern in a given row, the amount of blank space varies for each test pattern. The more blank space appearing for a white media sheet, the higher the reflectance detected by an optical sensor. The registration having the highest reflectance is chosen for each printhead under test to perform vertical registration.

According to another aspect of this invention, the registration of a printhead under test is varied without physically moving the printhead. Instead, the pattern of inkjet nozzles from which ink is ejected is shifted. For example, instead of starting from an end nozzle, to change the registration ink ejection starts from one nozzle inward from the end. Registration is shifted in units of one or more nozzles.

According to another aspect of this invention, the portion of each bar in a test pattern corresponding to a given color is of the same thickness (e.g., one dot). The intended spacing between bars is substantially thicker than the intended thickness of the bar. For example, the intended spacing may be 7 dot widths, while the intended thickness is one dot width. The actual spacing and thickness, of course, will vary due to the misalignment being corrected. Ideally, in the best registration the actual spacing and thickness equals the intended spacing and thickness. In some embodiments the intended spacing is the same within a given test pattern. In alternative embodiments the intended spacing varies within a given test pattern.

According to alternative embodiments, fewer rows of test patterns are printed. Within each row three or more colors are used. The relative registration of the printheads for such three or more colors varies with each test pattern in the row.

Note that although rows of test patterns are being described, the test patterns alternately may be columns of test patterns. Further the test patterns may extend in one direction for horizontal registration and in an orthogonal direction for vertical registration.

With regard to the paper advance distance calibration is implemented by printing a set of test patterns onto a media sheet. Each test pattern includes a first portion and a second portion which have a common pattern, size and shape. The portions are generally overlapping. At one step a first portion of one test pattern is printed using a first subset of nozzles. At another step, the media sheet is advanced by a media advancement distance. Then a second portion of the same test pattern is printed with a second subset of nozzles differing from the first subset. The second subset is picked so as to be spaced from the first subset approximately by media advancement distance. Accordingly, the second portion overlaps the first portion to define the first test pattern. The steps then are repeated for the other test patterns. The media advance distance is changed for each test pattern. Thus, the placement of the second portion of a given test pattern will vary relative to the first portion. The paper advance distance corresponding to the test pattern having best alignment between first portion and second portion is selected.

With regard to the method for calibrating portions of a printhead, the different portions of the printhead are used to print different portions of each of multiple test patterns. In one method inter-column alignment is calibrated. In another method printhead array length (e.g., swath height error) is calibrated. For each method multiple test patterns are printed using different parts of the printhead. Deviation from nominal offsets in the nozzle positions of a given printhead portion are determined from the degree of overlap among portions of a test pattern.

With regard to the method for calibrating bidirectional print alignment, multiple test patterns are printed. A first portion of each one of multiple test patterns is printed while scanning the printhead across the media sheet in a first direction. The spacing between each test pattern is the same. At another step a second portion of each of the test patterns is printed while scanning back across the media sheet in the opposite direction. The spacing between each second portion varies. Thus, the registration of the first portion and second portion of each test pattern varies among the patterns. The test pattern having the highest reflectance (e.g., most background space) corresponds to a calibration spacing to be used to achieve bidirectional printhead alignment.

One advantage of the invention is that by overlaying the inks of differing color a smaller area is used to perform color registration and printhead alignment. As a result, the registration process is faster. Another advantage is that the proper alignment may be identified visually by an operator. Another advantage is that all nozzles of a printhead may participate in the calibration process. This results in a more reliable alignment method which provides effective results even when one or more individual nozzles fail. These and other aspects and advantages of the invention will be better understood by reference to the following detailed description taken in conjunction with the accompanying drawings.

BRIEF DESCRIPTION OF THE DRAWINGS

FIG. 5 is a magnified view of a portion of a set of test patterns of FIG. 4;

FIG. 6 is a magnified view of a portion of a test pattern of FIG. 5 having desired registration according to one embodiment of this invention;

FIG. 7 is a magnified view of a portion of a test pattern of FIG. 5 having desired registration according to an alternative embodiment of this invention;

FIG. 8 is a magnified view of a portion of a test pattern of FIG. 5 having poor registration;

FIGS. 14*a*–14*c* are diagrams of a set of test patterns for calibrating array length variation;

FIGS. 15*a*–15*b* are diagrams of a set of test patterns for calibrating bidirectional printing alignment.

DESCRIPTION OF SPECIFIC EMBODIMENTS

Overview

Figure 1:
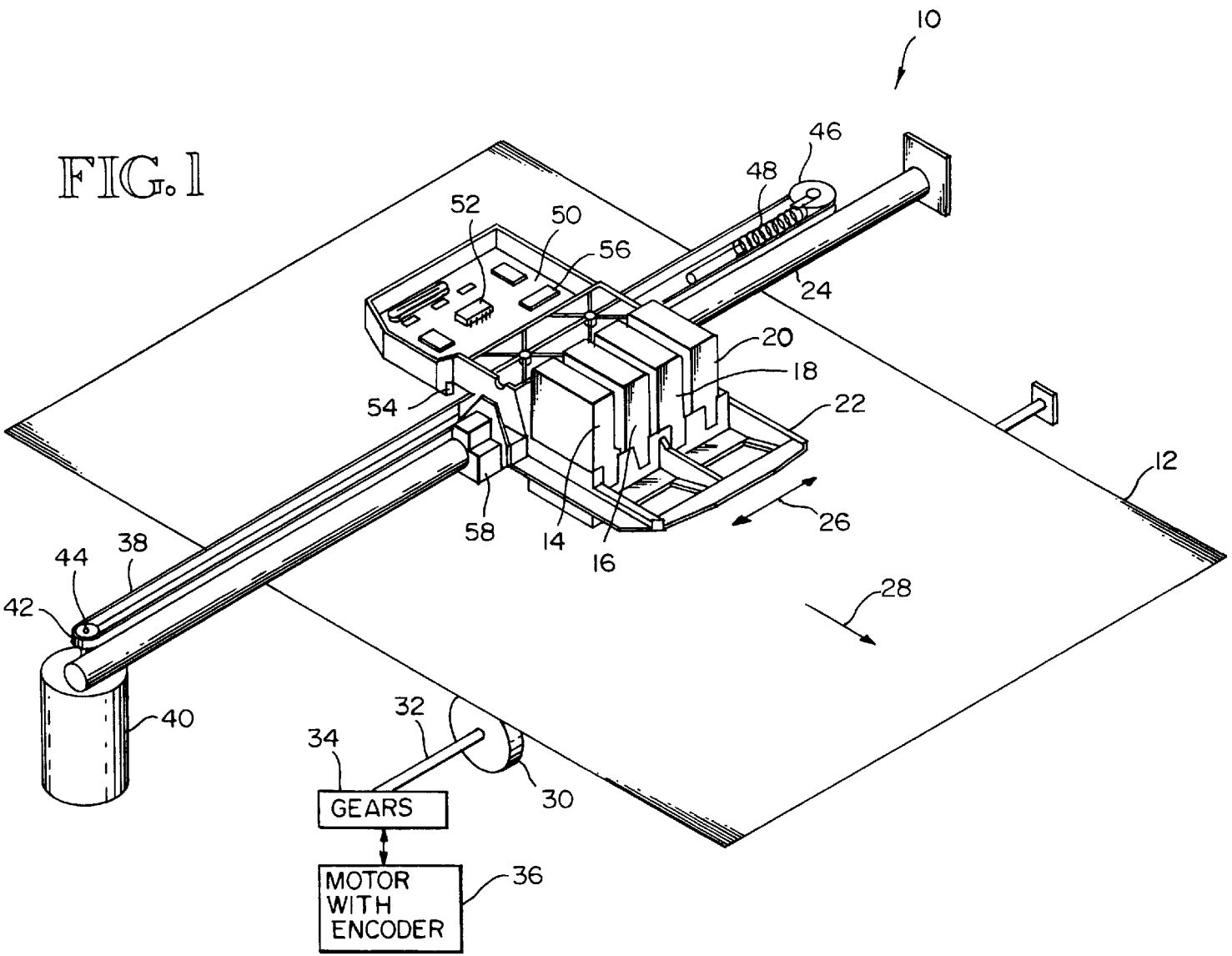
FIG. 1 is a perspective view of a portion of an inkjet printing apparatus according to an embodiment of this invention.

FIG. 1 shows a portion of a color inkjet marking apparatus 10. The apparatus 10 includes multiple inkjet pen 14, 16, 18, 20 which print characters, symbols, graphics or other imagery and markings onto a media sheet 12. The pens 14–20 are shuttled along a scanning axis 26, while the media sheet 12 is moved along a media path in a media direction 28. The scanning axis 26 is referred to herein as a horizontal axis 26 given the same part number. The media direction 28 corresponds to a vertical axis 28 given the same part number. The axes 26, 28 may be oppositely named. Other naming conventions also may be used. The media sheet 12 is moved by rollers 30 on an axle 32, which in turn are driven by gears 34 and a motor 36. The pens 14–20 are carried in a carriage 22 which moves along a carriage rod 24. A drive belt 38 coupled to the carriage 22 exerts a drive force which moves the carriage 22. A drive motor 40 generates the drive force. The motor 40 turns a drive pulley 42 on a drive shaft 44. The drive belt 38 runs along the drive pulley 42 and an idler pulley 46 coupled to an idler spring 48.

Carriage position and media sheet position are monitored by a processor 52. Carriage position is derived from a signal from a digital encoder 56 indicative of drive belt position. Media sheet position is determined from signals marking the passing of a media sheet at a known point and from a signal from a digital encoder. The motor 36 includes the digital encoder for tracking the roller 30 position. An optical sensor 54 detects the passing edge of the media sheet 12. Another optical sensor 58 moves with the carriage 22 along the carriage rod 24 for use in calibrating image registration.

Figure 2:
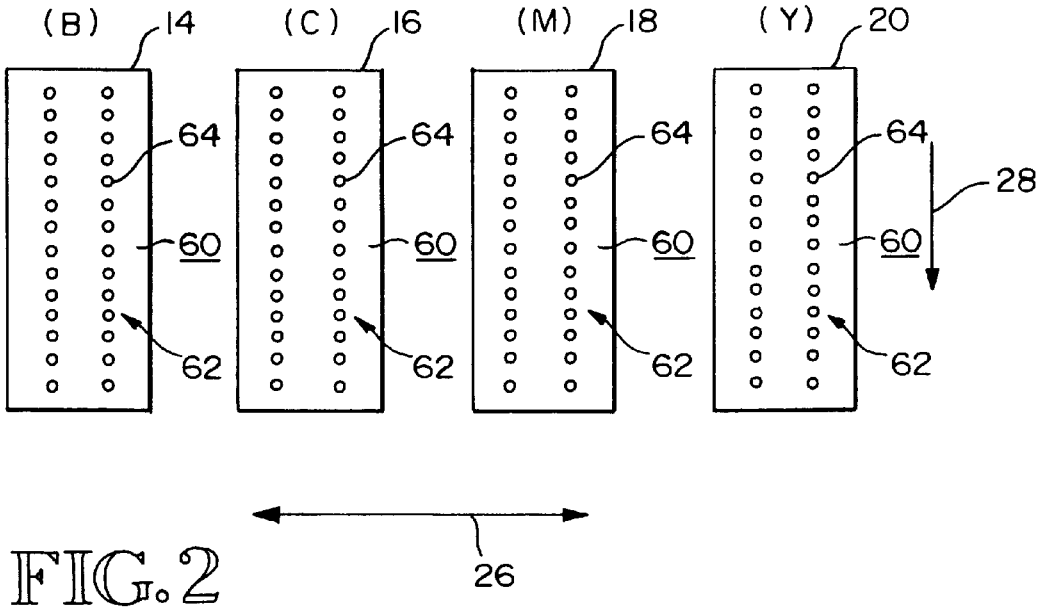
FIG. 2 is a diagram of printheads for the inkjet pens of FIG. 1.
Figure 3:
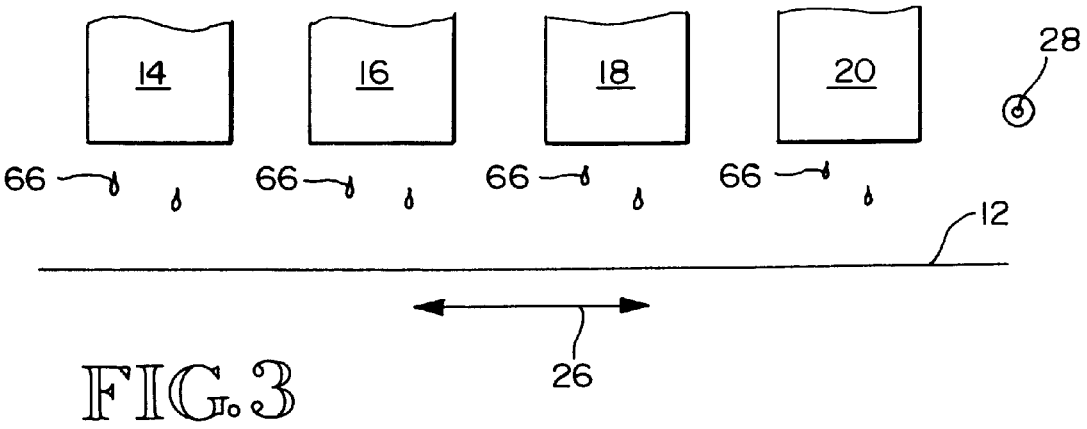
FIG. 3 is a diagram of ink drop ejection from the pens of FIG. 1 onto a media sheet.

The inkjet pens 14–20 store ink of different colors, e.g., black, cyan, magenta and yellow. As the carriage 22 and media sheet 12 translate relative to each other, the pens 14–20 scan the media sheet along the horizontal axis 26 and vertical axis 28. Referring to FIG. 2, each pen 14–20 includes a printhead 60 having an array 62 of nozzles 64. The nozzles 64 eject ink drops 66 onto the media sheet 12 as shown in FIG. 3. The number of drops, the density of the drops and the ink color of the drops determine the colors perceived by a viewer in a printed image or marking. Accordingly, to achieve accurate printing of desired colors it is important that the ink drops be placed precisely in desired positions. One challenge to such positioning is misalignment of the pens 14–20 in the carriage 22. Once the pens are locked into the carriage 22 there position is generally fixed. However, such position may vary when a pen is removed or replaced. To assure high quality printing, the registration of dots from the various printheads 60 of pens 14–20 are calibrated so that the printheads 60 are in a known position relative to each other.

Test Patterns

Figure 4:
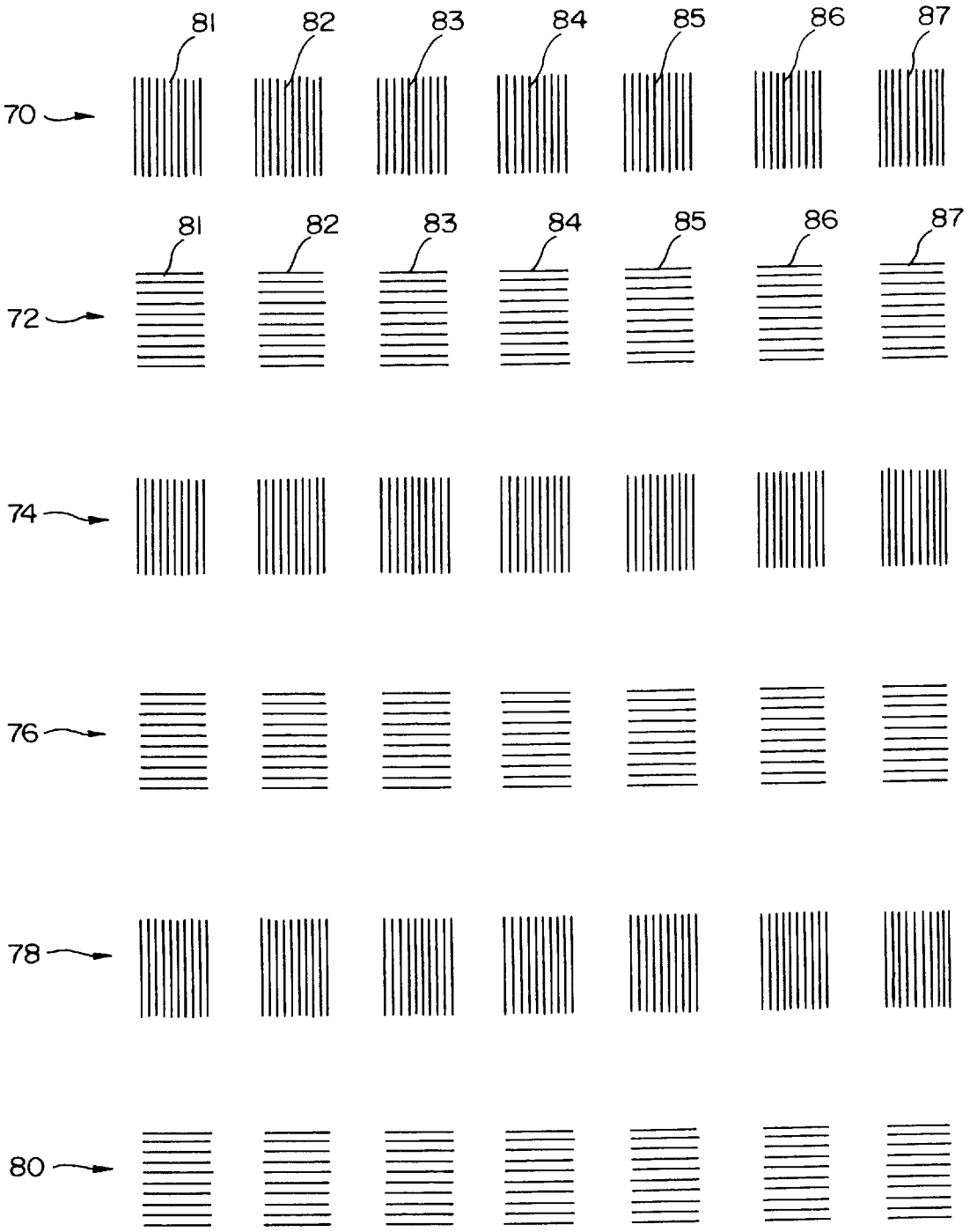
FIG. 4 is a diagram depicting multiple sets of test patterns according to an embodiment of this invention.

FIG. 4 shows multiple sets 70, 72, 74, 78, 80 of test patterns used for calibrating registration of the printheads 60 of the inkjet pens 14–20. In the embodiment illustrated each set includes 7 test patterns 81–87, although the number may vary. In a preferred embodiment one printhead is taken to be a reference. The other printheads are calibrated relative to the position of such printhead. Registration of each of the non-reference printhead from corresponding pens 14, 16 and 20 is calibrated along both the horizontal axis 26 and the vertical axis 28. There is a set of test patterns for each calibration of each non-reference printhead. Thus, FIG. 4 shows six sets of test patterns. For example, set 70 is for calibrating the black pen 14 printhead relative to the horizontal axis. Set 72 is for calibrating the black pen 14 printhead relative to the vertical axis. Set 74 is for calibrating the cyan pen 16 printhead relative to the horizontal axis. Set 76 is for calibrating the cyan pen 16 printhead relative to the vertical axis. Set 78 is for calibrating the yellow pen 20 printhead relative to the horizontal axis. Set 80 is for calibrating the yellow pen 20 printhead relative to the vertical axis. The ordering of the sets may vary. Each set 70–80 of test patterns is arranged along the horizontal axis 26, although in other embodiments they may be aligned along the vertical axis 28. Further, in some embodiments the horizontal calibration sets 70, 74, 78 may be aligned along one of the axes 26, 28 while the vertical calibration sets 72, 76, 80 are aligned on the other of the axes 26, 28.

Each set 70, 74, 78 for horizontal calibration includes a plurality of vertical bars spaced apart along the horizontal axis 26. Conversely, each set 72, 76, 80 for vertical calibration includes a plurality of horizontal bars spaced apart along the vertical axis 23. Although bars are shown and described, circles, diamonds, squares or other shapes may be used. Each test pattern 70–80 includes two portions. Each portion is of the same size and shape. One portion is formed of ink drops from the reference pen 18 printhead, while the other portion is formed of ink drops from the printhead being calibrated. Thus sets 70, 72 include magenta ink drops from the reference pen 18 printhead and black ink drops from the pen 14 printhead. Sets 74, 76 include magenta ink drops from the reference pen 18 printhead and cyan ink drops from the pen 16 printhead. Sets 78, 80 include magenta ink drops from the reference pen 18 printhead and yellow ink drops from the pen 20 printhead.

Within each given set 70–80 of test patterns, the registration of the reference pen 18 printhead is the same for each test pattern 81–87, while the registration of the pen printhead under test varies for each test pattern 81–87. FIG. 5 shows 4 test patterns 83–86 of a given set of test patterns for a sample process for calibrating cyan ink pen 16 printhead for the horizontal axis 26. As described above each test pattern includes a plurality of vertical bars horizontally spaced. For purposes of illustration the reference ink bars 90 are drawn as solid lines and the cyan bars 92 are drawn as dashed lines. From test pattern 83 to test pattern 86 the registration of the cyan bars 92 is shifting left on the page of the drawing. In test pattern 85 the cyan bars 92 and reference bars 90 overlap.

FIG. 6 shows a magnified view of a portion of the sample test pattern 85 of FIG. 5 having the desired registration along axis 27 (e.g., one of axes 26, 28). Three bars 94, 96, 98 are shown. Each bar is shown as a plurality of ink drops. For purposes of illustration a reference color ink drop is depicted with an 'x', while the printhead under test ink drops (e.g., cyan) are depicted with an 'o'. In one embodiment, the dots of the respective printhead also overlap for the desired registration. In another embodiment, every other nozzle is used in the test pattern to draw the bars 90, 92. FIG. 7 shows the example where the bars 90, 92 overlap to define the respective bars 94', 96', 98' of a test pattern 85' having the desired registration along the axis 27 being calibrated.

For the desired registration the bars from the reference pen 18 printhead and the bars from the pen under test overly each other. In the FIG. 6 embodiment the dots of the two colors also overly each other. In the FIG. 7 embodiment the dots align along the non-calibrating axis irrespective of whether the dots themselves overlap, (e.g., for horizontal calibration, the dots align vertically even if they do not overlap). FIG. 8 shows a magnified view of a portion of a sample test pattern 83 having poor registration. In a poor registration the bars from the reference pen 18 printhead and the bars from the printhead under test do not overlap. Each bar 90, 92 is shown as a plurality of ink drops. For purposes of illustration a reference color ink drop is depicted with an 'x', while each printhead under test ink drop (e.g., cyan) is depicted with an 'o'. Note that test pattern 85 is shown to have desired registration and test pattern 83 is shown to have poor registration. The test pattern of a given set of test patterns having the best registration need not be pattern 85 and may differ from one set to the next. Similarly, test pattern 83 need not be a poor test pattern. These were represented as having desired registration and poor registration merely for purposes of illustration and description. Although FIGS. 5–8 depict dots for a test pattern having vertical lines, similar alignment and misalignment occurs for the test patterns formed by horizontal lines.

It is significant that the bars of differing color ink drops overlap in the desired registration and do not overlap in the poor registration. As the registration varies from desired to poor the degree of overlap decreases. As the amount of overlap decreases, the amount of background media sheet covered with ink increases. According to an aspect of this invention, the reflectance of the media sheet is sensed for each test pattern 81–87 in a set of test patterns. The test pattern having the highest reflectance is the test pattern having the best degree of overlapping, and thus the best registration.

In a preferred embodiment each bar of a given color ink in a test pattern has the same number of dots in width. The bars from a given pen are spaced apart by at least two dot widths. In an exemplary embodiment, each bar of a given color ink is one dot wide and spaced five dots apart. The width of a bar is the same for each printhead. The spacing between bars of a given color is the same for each color ink. What varies is the registration of the bars of one color ink relative to the bars of the reference color ink. A best registration is selected for each set of test patterns, and thus, for each printhead under test in each of the axes 26, 28. The best registration is that corresponding to the test pattern having the highest reflectance within a set of test patterns.

Figure 9:
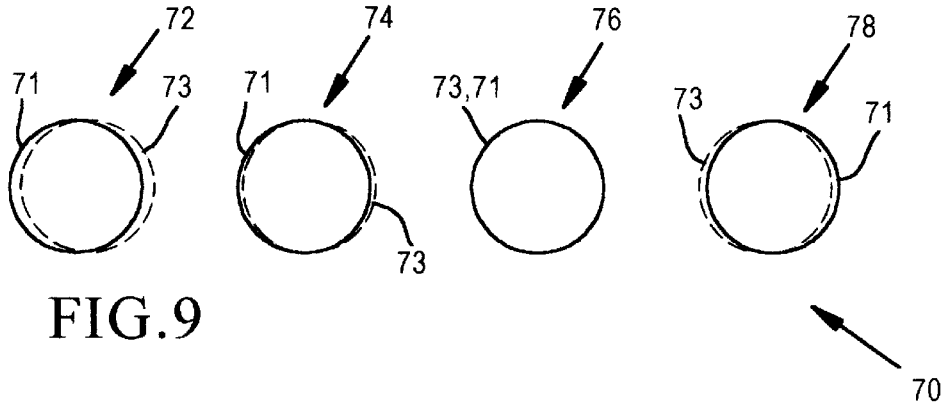
FIG. 9 is a diagram of test patterns according to another embodiment of this invention.

FIG. 9 shows a plurality 70 of test patterns 72–78 according to another embodiment of this invention. Each test pattern includes two portions 71, 73. For each test pattern, one portion 71 is printed from one inkjet printhead, while the other portion 73 is printed from another inkjet printhead. One inkjet printhead serves as a reference printhead. The other inkjet printhead is a printhead being calibrated. The image registration for the calibrated printhead is varied for each test pattern 72–78. Such image registration may be varied among one two printing axes. In another embodiment each test pattern may include more than two portions with each portion being printed by a different printhead. Image registration of at least one printhead is changed for each test pattern. At least one other pen serves as a reference printhead in which its image registration is the same for each test pattern.

Figure 10:
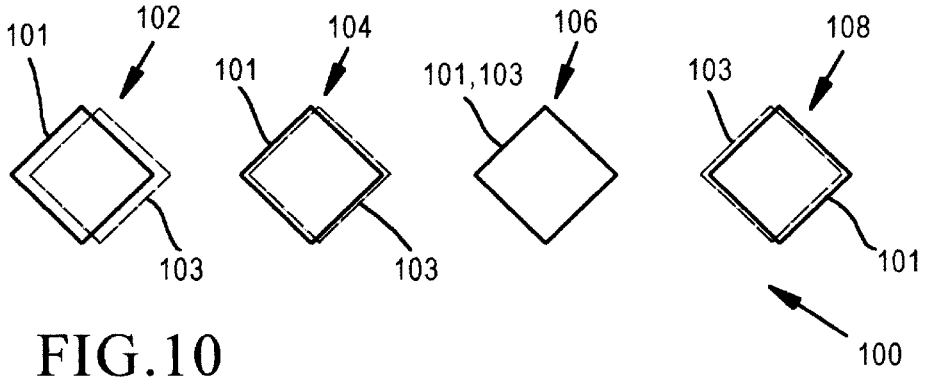
FIG. 10 is a diagram of test patterns according to another embodiment of this invention.

Each portion 71, 73 has the same size and shape. Each test pattern 72–78 is generally circular. FIG. 10 shows another plurality 100 of test patterns 102–108 in which each portion 101, 103 is diamond shaped. Although, test patterns have been described and illustrated to include one or more lines, circles or diamonds, other shapes also may be used.

Method of Calibrating Registration

To calibrate registration of a given printhead relative to a given axis 26, 28 a set of test patterns are printed. The set includes a plurality of test patterns. Each test pattern includes one or more bars, circles, diamonds or other shapes. For a test pattern formed by a plurality of bars, the bars are spaced apart along an axis of calibration. The bars are elongated in the direction perpendicular to the axis under calibration. For circles or diamonds having symmetry along either calibration axis, the orientation of the shape may be the same regardless of the calibration axis.

With regard to the test pattern of bars, to calibrate the black ink pen 14 printhead for the horizontal axis a plurality of vertical black bars are printed with horizontal spacing in each test pattern of the set. A similar plurality of bars are printed with the reference printhead for each given test pattern. Thus, each test pattern includes a plurality of bars of the printhead under test and the reference printhead. Optical sensor 58 then scans the set of test patterns to sample the reflectance of each test pattern. The processor 52 receives the sensor samples are derives a value indicative of reflectance for a scanned test pattern. A value is derived for each test pattern in the set. The processor identifies which test pattern has the highest reflectance. Such test pattern has the most overlapping of bars of the two colors (i.e., the ink colors of the printhead under test and of the reference printhead), and thus corresponds to the best registration for the axis calibrated. The registration used for such selected test pattern is the registration selected for the printhead under test for the axis calibrated. Another set of test patterns then is printed for calibrating relative to the other axis 26, 28. The process is repeated to calibrate registration of each printhead relative to a reference printhead. One of the four pens 14–10 is selected as the reference printhead as described above.

To vary the registration of the printhead under test from one test pattern to the next the timing or assignment of nozzles to eject ink drops is changed. According to one embodiment the registration is changed by one nozzle width from one test pattern to the next test pattern in a given set of test patterns. The unit of change among test patterns however may vary and need not be of constant increments.

There are many variables which may change from embodiment to embodiment, such as the number of bars of a given color ink per test pattern, the spacing between bars, the thickness of each bar, the dot density of each bar, and the change in registration from one pattern to the next. Alignment is achievable for spatial resolutions as fine as 0.25 dot rows.

In an alternative embodiment, more than two colors of ink may be used in one or more, sets of test patterns of test patterns so that fewer sets of test patterns are printed to calibrate registration. In such an embodiment the registration of one or more printheads is varied while the registration of at least one printhead is held constant for a given set of test patterns. Consider an example in which four sets 70, 72, 74, 76 are printed. Sets 70 and 74 are for calibrating along one axis and sets 72, 76 are for calibrating along the orthogonal axis. In sets 70 and 72 three printheads are used. The registration of two printheads are varied from test pattern to test pattern, while that of the third is held constant. The registrations corresponding to the test pattern with the highest reflectance then are selected for each axis. The remaining sets 74, 76 then are used to calibrate the desired registration along the respective axes for the remaining printhead. Thus, sets 74, 76 include bars printed from the remaining printhead not included in sets 70, 72 and at least one other printhead. Sets 74, 76 may use ink from 2, 3 or 4 printheads. Only the registration of the remaining printhead is changed from pattern to pattern in sets 74, 76. The patterns of set 74 are scanned. The registration corresponding to the pattern with the highest reflectance is used for such remaining printhead. Such registration is the calibrated registration along the axis calibrated using set 74. Similarly, the patterns of set 76 are scanned. The registration corresponding to the pattern with the highest reflectance is used for such remaining pen. Such registration is the calibrated registration along the axis calibrated using set 76.

In another embodiment an operator inspects the test patterns, rather than an optical sensor. In one example, an operator enters a pattern number to identify which pattern has the best alignment.

In a best mode multi-color printing embodiment, the reference printhead ejects black ink.

Method for Calibrating Paper Advancement Distance

Figure 11:
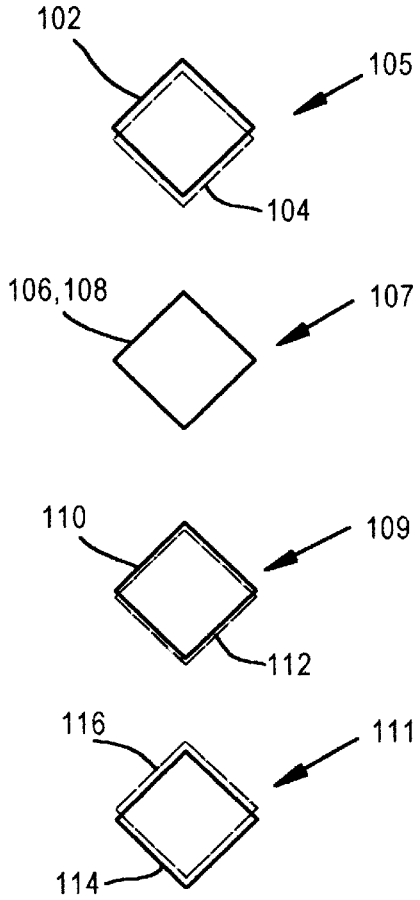
FIG. 11 is a diagram of test patterns for a method of calibrating paper advancement distance.

Referring to FIG. 11, a method for calibrating a most desirable paper advancement distance is implemented by printing a set of test patterns 105, 107, 109, 111 onto a media sheet. Each test pattern includes a first portion and a second portion which have a common pattern, size and shape. The portions are generally overlapping. At one step a first portion 102 of test pattern 105 is printed using a first subset of nozzles of an inkjet printhead 60. At another step, the media sheet is advanced by a media advancement distance. Then a second portion 104 of test pattern 105 is printed with a second subset of nozzles differing from the first subset. The second subset is picked so as to be spaced from the first subset approximately by media advancement distance. Accordingly, the second portion 104 overlaps the first portion 102.

Next, the media is advanced to a clean area of the media sheet and the steps then are repeated to achieve test pattern 107 with generally overlapping test pattern portions 106 and 108. The portion 106 is printed using the first subset of nozzles while portion 108 is printed using the second subset of nozzles. For test patterns 107, the media advancement distance is different than the distance moved between printing the portions 102 and 104 of test pattern 105. Thus, the overlapping of test pattern 107 portions 106 and 108 differs from the overlapping of test pattern 105 portions 102 and 104. More particularly the amount of blank space, and thus the reflectance among the test patterns 105, 107 varies.

The media sheet then is advanced again to a clean area of the media sheet and the steps then are repeated to achieve test pattern 109 with generally overlapping test pattern portions 110 and 112. The portion 110 is printed using the first subset of nozzles while portion 112 is printed using the second subset of nozzles. For test pattern 109, the media advancement distance is different than the distance moved between printing the portions 102 and 104 of test pattern 105, and between printing the portions 106 and 108 of test pattern 107. Thus, the overlapping of test pattern 109 portions 110 and 112 differs from the overlapping in test pattern 105 and in test pattern 107. More particularly the amount of blank space, and thus the reflectance among the test patterns 105, 107 and 109 varies.

The media sheet then is advanced again to a clean area of the media sheet and the steps then are repeated to achieve test pattern 111 with generally overlapping test pattern portions 114 and 116. The portion 114 is printed using the first subset of nozzles while portion 116 is printed using the second subset of nozzles. For test pattern 111, the media advancement distance is different than the distance moved between printing the portions of test patterns 105, 107 and 109. Thus, the overlapping of test pattern 111 portions 114 and 116 differs from the overlapping in test patterns 105, 107 and 109. More particularly the amount of blank space, and thus the reflectance among the test patterns 105, 107 and 109 varies. Note that the spacing between test pattern portions in a given test pattern is exaggerated for purposes of illustration. Further, dotted lines are used for one portion of a test pattern while solid lines are used for the other portion for purposes of illustration. Preferably each test pattern portion within a given test pattern is the same. The various test patterns 105, 107, 109 and 111, however, may vary in a given embodiment.

Optical sensor 58 then scans the set of test patterns 105, 107, 109, 111 to sample the reflectance of each test pattern. The processor 52 receives the sensor samples are derives a value indicative of reflectance for a scanned test pattern. A value is derived for each test pattern. The processor identifies which test pattern has the highest reflectance. Such test pattern has the most closely aligned overlapping portions, and corresponds to a best paper advancement distance. The paper advancement distance used for such selected test pattern is the paper advancement distance selected.

For a printing apparatus in which the paper advancement has a consistent paper advance error, the paper advance can be calibrated according to the method described above or by an alternative method. In the alternative method, the paper advance can be measured in terms of the number of nozzles moved and by which nozzles line up. The paper advance is altered by changing the paper advance distance in proportion to the measured nozzle distance. According to the alternative method, the paper advance is calibrated together with printhead nozzle array length as described below with regard to FIGS. 14A–C.

Method for Calibrating Different Parts of a Printhead

Figure 12:
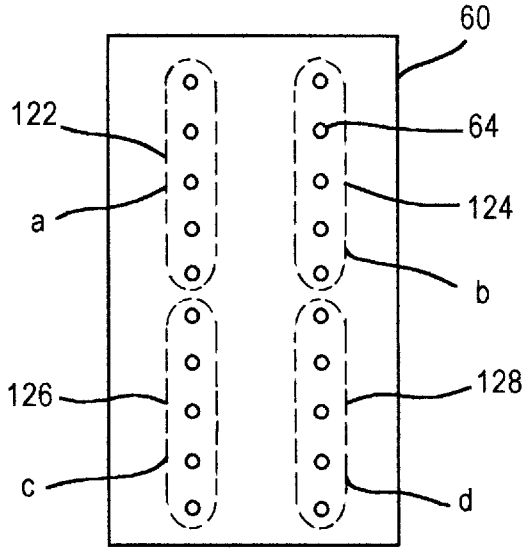
FIG. 12 is a diagram of a printhead nozzle layout having multiple printhead portions to be calibrated.

Referring to FIG. 12, a printhead 60 includes nozzles 64 allocated among four different portions 122, 124, 126, 128 to be calibrated. Such portions are referred to as portions a, b, c and d. In one method inter-column alignment is calibrated. In another method printhead array length is calibrated. For each method multiple test patterns are printed using different parts of the printhead. Deviation from nominal offsets in the nozzle positions of a given portion a, b, c or d are determined from the degree of overlap among portions of a test pattern. The test pattern preferably is a set of regularly spaced lines. However, other shaped may be used such as diamond patterns, circular patterns, square pattern and other regular or irregular shaped patterns.

Figure 13A:
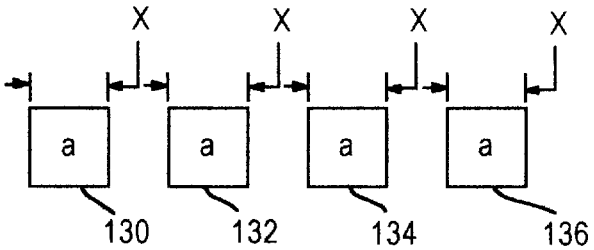
FIGS. 13*a*–13*c* are diagrams of a set of test patterns for calibrating intercolumn printhead alignment.
Figure 13B:
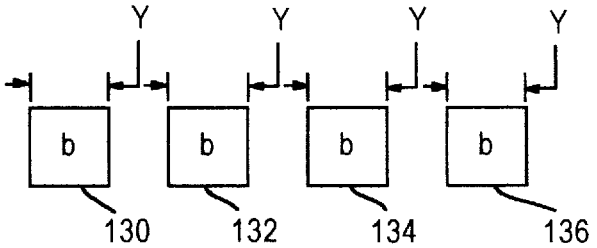
Figure 13C:
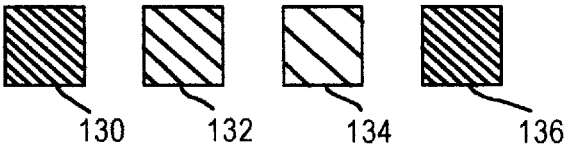

For the inter-column alignment calibration method, a first portion of each of multiple test patterns 130, 132, 134, 136 is printed using nozzles from printhead portion a as shown in FIG. 13*a*. Each portion is spaced from the next portion by a distance x. Referring to FIG. 13*b,* at another step a second portion of each of the multiple test patterns is printed using nozzles from portion b. Note that the first portion and second portion of each test pattern may be printed on the same scan of the inkjet pen across the media sheet. The first portion and the second portion of each test pattern are identical. The second portions, however, are printed at a spacing y between each test portion. For the second portions to precisely overlay the respective first portions, the nominal inter-column distance between the nozzles in printhead portion a and printhead portion b are to be accounted for in determining the starting position of pattern 130. By using a spacing y distinct from x, the different patterns will be printed with offsets that are multiples of the x-y distance. Referring to FIG. 13*c,* each test pattern 130–136 will have a different reflectance as some dots are superimposed. The intercolumn offset distance used to achieve the test pattern having the highest reflectance (i.e., most overlay) is added to the nominal inter-column distance to determine the actual inter-column distance.

For the printhead array length calibration method, a first portion of each of multiple test patterns 140, 142, 144, 146 is printed using nozzles from printhead portion a as shown in FIG. 14*a.* Next, the media sheet is advanced by a nominal distance equivalent to the distance between the centroids of the nozzle groups to be aligned. Referring to FIG. 14*b,* at another step a second portion of each of the multiple test patterns is printed using nozzles from portion c. The first portion and the second portion of each test pattern are identical. For each test pattern 140–146 the second portions are offset vertically by a small amount (e.g., one nozzle spacing). For the second portions to precisely overlay the respective first portions, the printhead array length variation between printhead portions a and c is compensated for, as is the paper advance distance. Referring to FIG. 14*c,* each test pattern 140–146 will have a different reflectance as some dots are superimposed. The test pattern having the highest reflectance corresponds to the array length variation between portions a and c for a given paper advance increment. In effect array length and paper advance are calibrated together.

Method for Calibrating Bidirectional Printhead Alignment

To calibrate image registration variations for printing while scanning in one direction across a media sheet versus printing while scanning in the opposite direction across the media sheet, a calibration process is performed. As with the other calibration methods described above, multiple test patterns are printed. Referring to FIG. 15*a* a first portion of each one of multiple test patterns 150, 152, 154, 156 is printed while scanning the inkjet printhead 60 across the media sheet in a first direction 148. The spacing between each test pattern is the same. At another step a second portion of each of the test patterns is printed while scanning back across the media sheet in the opposite direction 149. The spacing between each second portion, however varies. Thus, the registration of the first portion and second portion of each test pattern 150–156 varies;. The test pattern of 150–156 having the highest reflectance (e.g., most background space) corresponds to a calibration spacing to be used to achieve bidirectional printhead alignment.

Although preferred embodiments of the invention have been illustrated and described, various alternatives, modifications and equivalents may be used. For example, the method may be implemented conversely in which printheads attempt to print completely out of phase. The test pattern with the minimal reflectance would then corresponds to the best alignment. For some alternate test patterns, such as concentric circles or diamonds, the test patterns can alternately be evaluated for the consistency of the reflectance across the pattern, where the most consistent reflectance across the pattern indicates the best alignment. Therefore, the foregoing description should not be taken as limiting the scope of the inventions which are defined by the appended claims.

What is claimed is:

1. A method for calibrating image registration for two inkjet printheads, each printhead including a plurality of inkjet nozzles, the method comprising the steps of:

automatically printing a first plurality of test patterns onto a media sheet, each one test pattern of the plurality of test patterns including a first portion printed with a first inkjet printhead and a second portion printed with a second inkjet printhead, wherein the first portion and second portion are of the same shape, wherein image registration of one of said two inkjet printheads is varied automatically among each one of the plurality of test patterns;

sensing reflectance of each one test pattern of the plurality deriving a reflectance value for said each one test pattern of the plurality of test patterns, said derived reflectance value indicative of the sensed reflectance, and selecting the image registration corresponding to a select test pattern of the plurality of test patterns which has a reflectance value indicative of said select test pattern having the most unprinted background area.

2. The method of claim 1, in which the first inkjet printhead prints ink of a differing color than the second inkjet printhead.

3. A method for calibrating image registration for two inkjet printheads, each printhead including a plurality of inkjet nozzles, the method comprising the steps of:

automatically printing a first plurality of test patterns onto a media sheet each one test pattern of the plurality of test patterns including a first portion printed with a first inkjet printhead and a second portion printed with a second inkjet printhead, wherein the first portion and second portion are of the same shape wherein image registration of one printhead of said two printheads is varied automatically for each one test pattern by automatically changing a selection of nozzles of said one printhead used in printing said one test pattern;

inspecting the plurality of test patterns; and selecting the image registration corresponding to one of the plurality of test patterns having the most unprinted background area.

4. A method for calibrating image registration for two inkjet printheads of differing color for a prescribed axis, each printhead including a plurality of inkjet nozzles, the method comprising the steps of:

automatically printing a first plurality of test patterns onto a media sheet, each one test pattern of the plurality of test patterns including a first portion printed with a first inkjet printhead and a second portion printed with a second inkjet printhead, wherein the first portion and second portion are of the same shape, wherein image registration of one of said two inkjet printheads is varied automatically among each one of the plurality of test patterns;

sensing reflectance of each one test pattern of the plurality deriving a reflectance value for said each one test pattern of the plurality of test patterns, said derived reflectance value indicative of the sensed reflectance; and selecting the image registration corresponding to a select test pattern of the plurality of test patterns which has a reflectance value indicative of said select test pattern having the most unprinted background area.

5. The method of claim 4, in which the first inkjet printhead prints ink of a differing color than the second inkjet printhead.

6. The method of claim 4, in which each bar includes one line of ink dots.

7. A method for calibrating image registration for two inkjet printheads of differing color for a prescribed axis, each printhead including a plurality of inkjet nozzles, the method comprising the steps of:

automatically printing a first plurality of test patterns onto a media sheet each one test pattern of the plurality of test patterns including a first portion printed with a first inkjet printhead and a second portion printed with a second inkjet printhead wherein the first portion and second portion are of the same shape, wherein image registration of one printhead of said two printheads is varied automatically for each one test pattern by automatically changing a selection of nozzles of said one printhead used in printing said one test pattern;

inspecting the plurality of test patterns; and selecting the image registration corresponding to one of the plurality of test patterns having the most unprinted background area.

8. A method for creating a set of test patterns for image registering a plurality of inkjet printheads of differing color, including the steps of:

printing a first plurality of test patterns, wherein each one of the first plurality of test patterns includes a plurality of horizontally-spaced vertical bars and is formed by printing ink drops from at least two of the plurality of inkjet printheads, wherein horizontal registration of at least one of said two of the plurality of inkjet printheads is varied among each one of the first plurality of test patterns; and printing a second plurality of test patterns, wherein each one of the second plurality of test patterns includes a plurality of vertically-spaced horizontal bars and is formed by printing ink drops from at least two of the plurality of inkjet printheads, wherein vertical registration of at least one of said two of the plurality of inkjet printheads is varied among each one of the second plurality of test patterns.

9. The method of claim 8, in which the first plurality of test patterns are formed by printing ink drops from a reference printhead and a first printhead of the plurality of inkjet printheads, and in which the second plurality of test patterns are formed by printing ink drops from the reference printhead and the first printhead of the plurality of inkjet printheads, and further comprising the steps of:

printing a third plurality of test patterns, wherein each one of the third plurality of test patterns includes a plurality of horizontally-spaced vertical bars and is formed by printing ink drops from the reference printhead and a second printhead of the plurality of inkjet printheads, wherein horizontal registration of the second printhead is varied among each one of the first plurality of test patterns; and printing a fourth plurality of test patterns, wherein each one of the fourth plurality of test patterns includes a plurality of vertically-spaced horizontal bars and is formed by printing ink drops from the reference printhead and the second printhead, and wherein vertical registration of the second printhead is varied among each one of the second plurality of test patterns.

10. The method of claim 8, in which the step of printing the first plurality of test patterns comprises printing the first plurality of test patterns along a first axis, and in which the step of printing the second plurality of test patterns comprises printing the second plurality of test patterns along the first axis.

11. The method of claim 8, in which each bar includes one line of ink dots.

12. A method for aligning a plurality of inkjet printheads which print ink of differing color along a first axis and a second axis, each printhead including a plurality of inkjet nozzles, the method comprising the steps of:

printing a first plurality of test patterns onto a media sheet, wherein each one of the first plurality of test patterns includes a plurality of bars spaced along the first axis on the media sheet, each one of the first plurality of test patterns formed by printing ink drops from a reference printhead of the plurality of inkjet printheads and a first printhead of the plurality of inkjet printheads, wherein image registration for the first axis of said first printhead is varied among each one of the first plurality of test patterns;

sensing the reflectance of each one of the first plurality of test patterns;

deriving a reflectance value for each one of the first plurality of test patterns corresponding to sensed reflectance;

selecting image registration for the first axis for said first printhead to be the image registration in the test pattern of the first plurality of test patterns having the reflectance value which corresponds to a highest reflectance;

for each other printhead of the plurality of inkjet printheads other than the reference printhead and the first printhead, repeating the steps of printing a first plurality of test patterns, sensing reflectance of each one of the first plurality of test patterns deriving the reflectance value, and selecting image registration for the first axis to select the image registration for the first axis for said each other printhead;

printing a second plurality of test patterns onto a media sheet, wherein each one of the second plurality of test patterns includes a plurality of bars spaced along the second axis on the media sheet, each one of the second plurality of test patterns formed by printing ink drops from the reference printhead and the first printhead, wherein image registration along the second axis of the first printhead is varied among each one of the second plurality of test patterns;

sensing the reflectance of each one of the second plurality of test patterns;

deriving a reflectance value for each one of the second plurality of test patterns corresponding to sensed reflectance, selecting image registration for the second axis for said first printhead to be the image registration in the test pattern of the second plurality of test patterns having the reflectance value which corresponds to a highest reflectance; and for each other printhead of the plurality of inkjet printheads other than the reference printhead and the first printhead, repeating the steps of printing a second plurality of test patterns, sensing reflectance of each one of the second plurality of test patterns deriving the reflectance value, and selecting image registration for the second axis to select the image registration for the second axis for said each other printhead.

13. The method of claim 12, wherein image registration of a printhead is varied by changing a selection of nozzles of said printhead used for printing a test pattern corresponding to said image registration.

14. The method of claim 12, in which each bar includes one line of ink dots.

15. An image registration system for a multi-color inkjet marking apparatus, comprising:

a plurality of inkjet printheads, each printhead of the plurality of printheads storing ink of a respective color and having a plurality of nozzles adapted to discharge ink in response to a corresponding electrical signal;

a carriage retaining the plurality of inkjet printheads, the carriage moving along a first axis;

means for moving a media sheet along a second axis perpendicular to the first axis;

control means for providing electrical signals for causing said nozzles to eject ink onto the media sheet and create a first plurality of test patterns and a second plurality of test patterns, wherein each one of the first plurality of test patterns includes a plurality of horizontally-spaced vertical bars and is formed by printing ink drops from at least two of the plurality of inkjet printheads, wherein horizontal registration of at least one of said two of the plurality of inkjet printheads is varied among each one of the first plurality of test patterns, and wherein each one of the second plurality of test patterns includes a plurality of vertically-spaced horizontal bars and is formed by printing ink drops from at least two of the plurality of inkjet printheads, wherein vertical registration of at least one of said two of the plurality of inkjet printheads is varied among each one of the second plurality of test patterns;

sensing means for optically sensing reflectance of each one of the first plurality of test patterns and each one of the second plurality of test patterns; and a processor means for sampling the sensing means, for determining which one of the first plurality of test patterns has the highest reflectance and which one of the second plurality of test patterns has the highest reflectance, and for setting horizontal registration and vertical registration for each one of the plurality of inkjet printheads.

16. An image registration system for a multi-color inkjet marking apparatus, comprising:

a plurality of inkjet printheads, each printhead of the plurality of printheads having a plurality of nozzles adapted to discharge ink in response to a corresponding electrical signal;

a carriage retaining the plurality of inkjet printheads, the carriage moving along a first axis;

means for moving a media sheet along a second axis perpendicular to the first axis;

control means for providing electrical signals for causing said nozzles to eject ink onto the media sheet and create a first plurality of test patterns, each one test pattern of the plurality of test patterns including a first portion printed with a first inkjet printhead and a second portion printed with a second inkjet printhead, wherein the first portion and second portion are of the same shape, wherein image registration of one of said two inkjet printheads is varied automatically among each one of the plurality of test patterns;

sensing means for optically sensing reflectance of each one of the first plurality of test patterns; and a processor means for sampling the sensing means, for deriving a reflectance value for each test pattern of the first plurality of test patterns, for determining which one of the first plurality of test patterns has the reflectance value which corresponds to the highest reflectance, and for setting image registration of at least one of the first inkjet printhead and the second inkjet printhead.

17. A method for calibrating media advance distance in an inkjet printer having a printhead with a plurality of nozzles, comprising the steps of:

printing a first portion of a first test pattern onto a media sheet using a first subset of the plurality of nozzles;

advancing the media sheet by a media advance distance;

overprinting a second portion of the first test pattern onto the media sheet in the area of the first portion using a second subset of the plurality of nozzles, wherein the second portion has a common pattern as the first portion;

iteratively repeating the steps of printing a first portion, advancing the media sheet and printing a second portion for additional test patterns, wherein the media advance distance is varied in each iteration, and wherein a plurality of test patterns is achieved corresponding to a plurality of the iterations;

sensing reflectance of each one test pattern of the plurality of test patterns;

deriving a reflectance value for said each one test pattern of the plurality of test patterns, said derived reflectance value indicative of the sensed reflectance; and selecting the media advance distance corresponding to a select test pattern of the plurality of test patterns which has a reflectance value indicative of said select test pattern having the most unprinted background area.

18. The method of claim 17, in which the selecting step comprises selecting the media advance distance corresponding to the test pattern exhibiting the most reflectance.

19. A method for calibrating inter-column alignment for an inkjet print head having a plurality of nozzles, the method comprising the steps of:

automatically printing a first portion of each one of a plurality of test patterns onto a media sheet using a first subset of the plurality of nozzles, wherein the first portion for said each one of the plurality of test patterns are spaced by a common interval;

overprinting a second portion of each one of the plurality of test patterns onto the media sheet in the area of the first portion using a second subset of the plurality of nozzles, wherein the second portion has a common pattern as the first portion, and wherein the second portion for said each one of the plurality of test patterns are spaced by a variable interval, and wherein the first subset of nozzles and the second subset comprise nozzles are from mutually exclusive columns of the plurality of columns;

inspecting the plurality of test patterns; and selecting the interval corresponding to the test pattern in which the first portion and second portion are most closely aligned as a calibrated inter-column offset.

20. The method of claim 19, wherein for each one of the plurality of test patterns, a selection of nozzles forming the second subset is automatically varied.

21. A method for calibrating array length variation within an inkjet printhead having a plurality of nozzles, the method comprising the steps of:

automatically printing a first portion of each one of a plurality of test patterns onto a media sheet using a first subset of the plurality of nozzles;

overprinting a second portion of each one of the plurality of test patterns onto the media sheet in the area of the first portion using a second subset of the plurality of nozzles, wherein the second portion has a common pattern as the first portions wherein the first subset of nozzles and the second subset comprise nozzles are from mutually exclusive portions of the printhead;

during the step of overprinting, advancing the media sheet;

inspecting the plurality of test patterns; and selecting a media sheet advance distance corresponding to the test pattern in which the first portion and second portion are most closely aligned as a calibrated array length offset.

22. The method of claim 21, wherein for each one of the plurality of test patterns, a selection of nozzles forming the second subset is automatically varied.

23. A method for calibrating image registration for bidirectional printing with in inkjet printhead having a plurality of nozzles, the method comprising the steps of:

printing a first portion of each one of a plurality of test patterns onto a media sheet while the printhead is scanned across the media sheet in a first direction, wherein the first portion for said each one are spaced by a common interval;

overprinting a second portion of each one of the plurality of test patterns onto the media sheet in the area of the first portion while the printhead is scanned across the media sheet in a second direction opposite the first direction, wherein the second portion has a common pattern as the first portion, and wherein the second portion for said each one are spaced by a variable interval;

sensing reflectance of each one test pattern of the plurality of test patterns;

deriving a reflectance value for said each one test pattern of the plurality of test patterns, said derived reflectance value indicative of the sensed reflectance; and selecting the interval corresponding to the select test pattern for which the reflectance value of the select test pattern indicates a highest reflectance value.

* * * * *